US010081019B1

(12) United States Patent
Whitman

(10) Patent No.: US 10,081,019 B1
(45) Date of Patent: Sep. 25, 2018

(54) MODULAR PORTABLE SLUICE BOX

(71) Applicant: Lucian D. Whitman, Lake Isabella, CA (US)

(72) Inventor: Lucian D. Whitman, Lake Isabella, CA (US)

( * ) Notice: Subject to any disclaimer, the term of this patent is extended or adjusted under 35 U.S.C. 154(b) by 0 days.

(21) Appl. No.: 15/605,929

(22) Filed: May 25, 2017

(51) Int. Cl.

| | |
|---|---|
| ***B03B 5/26*** | (2006.01) |
| ***B03B 5/72*** | (2006.01) |
| *B03B 7/00* | (2006.01) |
| *B03B 5/02* | (2006.01) |

(52) U.S. Cl.
CPC ..... *B03B 5/26* (2013.01); *B03B 5/72* (2013.01); *B03B 5/02* (2013.01); *B03B 7/00* (2013.01)

(58) Field of Classification Search
CPC .... B03B 5/02; B03B 5/26; B03B 5/72; B03B 7/00
USPC ..... 209/44.4, 405, 417, 420, 458
See application file for complete search history.

(56) References Cited

U.S. PATENT DOCUMENTS

| | | | | |
|---|---|---|---|---|
| 2,923,410 A | | 2/1960 | Tschmelitsch | |
| 3,799,415 A | | 3/1974 | Tidd | |
| 4,375,491 A | * | 3/1983 | Honig | B03B 5/26 209/485 |
| 4,525,270 A | * | 6/1985 | McCann | B03B 5/26 209/202 |
| 4,592,833 A | * | 6/1986 | Perdue | B03B 7/00 209/44 |
| 5,407,079 A | * | 4/1995 | Rancourt | B07B 7/06 209/142 |
| 5,785,182 A | * | 7/1998 | Ashcraft | B03B 5/26 209/44 |
| 6,675,975 B1 | * | 1/2004 | Cook | B01D 29/012 210/490 |
| 6,799,681 B1 | * | 10/2004 | Warren | B03B 5/26 209/268 |
| 7,063,214 B2 | * | 6/2006 | Schulte, Jr. | B01D 33/0376 209/405 |
| 7,909,172 B2 | * | 3/2011 | Carr | B07B 1/4645 209/393 |
| 8,322,536 B2 | | 12/2012 | Rieck | |
| 9,387,482 B2 | | 7/2016 | Goodrich et al. | |
| 2004/0245155 A1 | * | 12/2004 | Strong | B01D 33/0376 209/405 |

(Continued)

FOREIGN PATENT DOCUMENTS

GB 2 056 528 A 3/1981

OTHER PUBLICATIONS

"Folding Sluice Box" sold by goldfeverprospecting.com; http://www.goldfeverprospecting.com/foslbox50in.html; 4 pages; printed on Feb. 9, 2017.

*Primary Examiner* — Joseph C Rodriguez
*Assistant Examiner* — Kalyanavenkateshware Kumar
(74) *Attorney, Agent, or Firm* — Richard C. Litman

(57) ABSTRACT

The modular portable sluice box is constructed from a plurality of smaller sluice box modules. Each of the sluice box modules includes a lower wall having a pair of longitudinally opposed ends and a pair of laterally opposed ends. A plurality of riffles are formed on an upper surface of the lower wall. A pair of sidewalls are secured to the pair of laterally opposed ends of the lower wall, respectively, and project upward therefrom. One of the sluice box modules may be releasably connected to both a longitudinally adjacent sluice box module, and also to a laterally adjacent sluice box module.

10 Claims, 8 Drawing Sheets

(56) References Cited

U.S. PATENT DOCUMENTS

| | | | | |
|---|---|---|---|---|
| 2010/0193406 | A1* | 8/2010 | Alderson | B03B 5/26 209/44 |
| 2010/0236993 | A1* | 9/2010 | Goodrich | B03B 5/26 209/44 |
| 2015/0190814 | A1 | 7/2015 | Barass | |
| 2016/0023219 | A1 | 1/2016 | Mundhra | |

* cited by examiner

MODULAR PORTABLE SLUICE BOX

BACKGROUND OF THE INVENTION

1. Field of the Invention

The present invention relates to mining implements, and particularly to a modular portable sluice box.

2. Description of the Related Art

A sluice box is typically used for extracting ore and other desirable materials from running water. The use of the sluice box can be extended to any extraction process for removal of materials from a running liquid, such as removing contaminants (or desired products) from slurries. Early sluice boxes, such as those used during the Gold Rush, consisted of a simple wooden trough lined with raised obstructions placed at a 90° angle to the flow of the water. These obstructions are referred to as "riffles". When all of the gravel-gold mixture was run through the sluice box, the water would be shut off, and the riffles were removed. The heavy materials, which contained the gold, would then be gathered. This extracted material is referred to as the "concentrate". Several tons of gold-bearing gravel could be processed through the sluice box in this manner.

In use, the gold-bearing gravel, for example, is dumped into an upper end of the sluice, and the flow of water washes the material down the length of the trough defined by the box. The lighter pieces of gravel are carried in suspension down the entire length of the sluice box to come out as "tailings" at the lower end of the sluice box. Heavy material, such as gold, sinks quickly and is caught by the riffles. Once the riffles gather their fill of concentrate, the concentrate is then removed for extraction of the gold.

Modern sluice boxes are made with materials that are far lighter and more durable than the original sluice boxes used in during the Gold Rush. Presently, sluice boxes are typically made of sheet aluminum or composite plastic materials. This results in lighter and more portable units that are considerably more efficient at gathering even the finest of gold dust. FIG. 8 illustrates such a modern conventional sluice box. Sluice box 100 includes a diverter 102 and a sluice bed 104 to convey water and separate particles from the water. For example, such a sluice box may be used for placer mining, where gold or other minerals are separated from less dense debris by flushing water over placer ore. The diverter 102 collects water from a stream or other water source and diverts the water into the sluice bed 104. The diverter bottom 108 is typically smooth and connected to a pair of side walls 106*a*, 106*b*, which define an upstream end 112 and a downstream end 114 opposite the upstream end 112. The side walls 106*a*, 106*b* converge in a flow direction 110 so that the cross-sectional area of the diverter 102 at the upstream end 112 is greater than the cross-sectional area at the downstream end 114 of the diverter 102, i.e., the upstream end 112 is flared, thereby creating a tapering of the diverter 102 from the upstream end 112 towards the downstream end 114, facilitating the transference of water from the water source to the sluice bed 104.

The sluice bed 104 conveys the water and placer ore in the flow direction 110, allowing gravity to separate particles from the water. The sluice bed 104 includes the sluice channel 116 and the riffles 118. The sluice bed 104 may also include a drop zone 120. The sluice channel 116 provides a conduit for the water and placer ore to move in the flow direction 110. The sluice channel 116 includes a pair of side walls 134*a*, 134*b* and a bottom 136 operatively connected to the pair of side walls 134*a*, 134*b*. The drop zone 120 is immediately upstream of the riffles 118. In normal use, placer ore is positioned in the drop zone 120 (for example, by delivering a scoop from a hand shovel) to be conveyed by the water in the flow direction 110, the water entering through the diverter 102.

Despite lighter options for choice of materials used in the construction of sluice boxes, even modern sluice boxes are difficult to transport and store, particularly due to their size. A typical sluice box may be between four and eight feet in length and between one and two feet in width, thus making transportation of a sluice box, particularly to an outdoor water source, such as a stream or river, relatively difficult. Thus, a modular portable sluice box solving the aforementioned problems is desired.

SUMMARY OF THE INVENTION

The modular portable sluice box is constructed from a plurality of smaller sluice box modules, thus allowing the sluice box to be easily disassembled for storage and transport, and assembled in a variety of different configurations. Each of the sluice box modules includes a lower wall having a pair of longitudinally opposed ends and a pair of laterally opposed ends. A plurality of riffles are formed on an upper surface of the lower wall. A pair of sidewalls are respectively secured to the pair of laterally opposed ends of the lower wall and project upward therefrom. A first end of the pair of longitudinally opposed ends of the lower wall of one of the plurality of sluice box modules may be releasably connected to a second end of the pair of longitudinally opposed ends of the lower wall of a longitudinally adjacent one of the plurality of sluice box modules. Similarly, a first sidewall of the pair of sidewalls of one of the plurality of sluice box modules may be releasably connected to a second sidewall of the pair of sidewalls of a laterally adjacent one of the plurality of sluice box modules.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
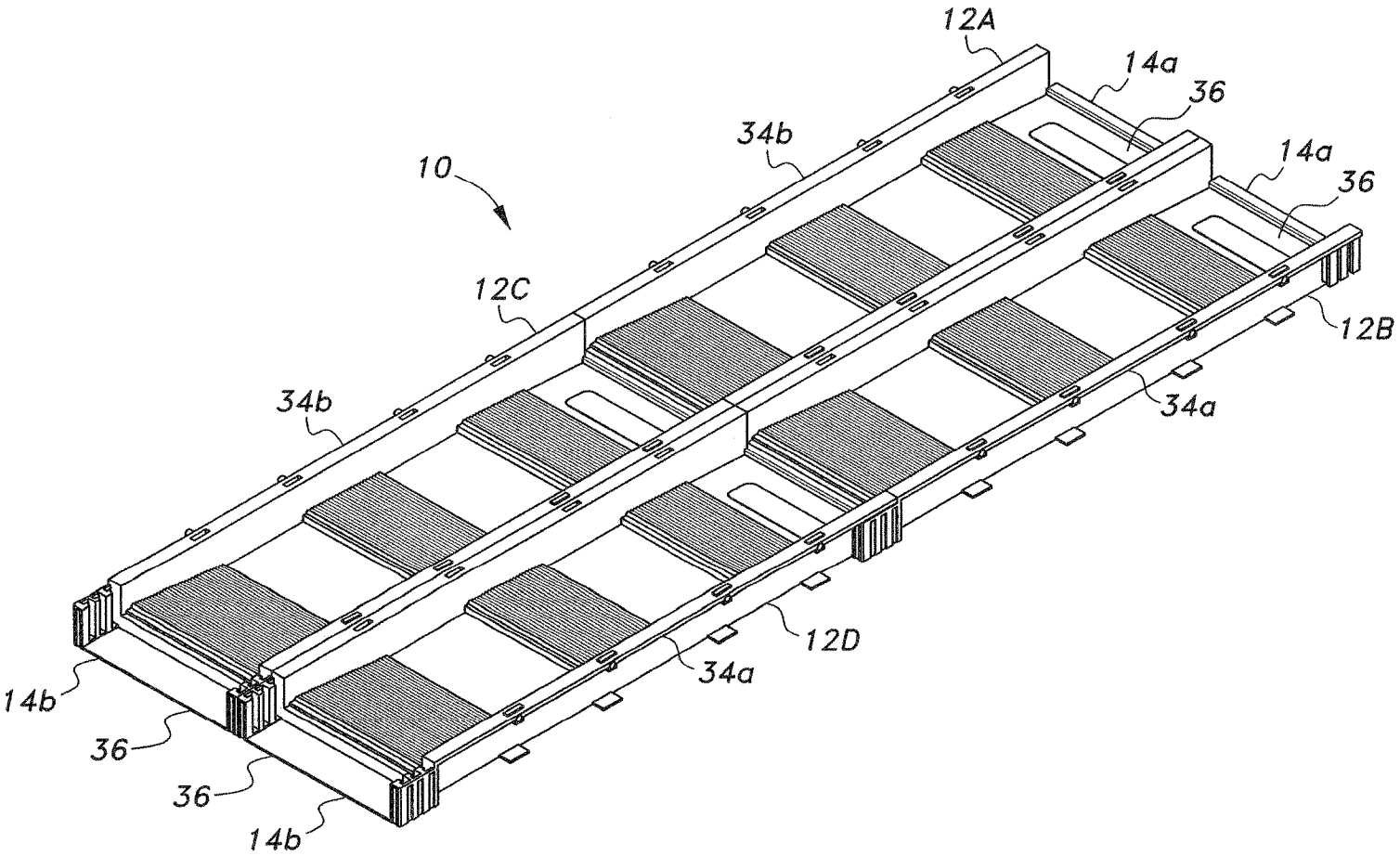
FIG. 1 is a perspective view of a modular portable sluice box according to the present invention.

The modular portable sluice box 10 is constructed from a plurality of smaller sluice box modules 12A, 12B, 12C, 12D, thus allowing the overall sluice box 10 to be easily disassembled for storage and transport and re-assembled in a variety of different configurations. In FIG. 1, four exemplary sluice box modules 12A, 12B, 12C, 12D are shown. However, it should be understood that this is only for purposes of illustration, and any desired number of sluice box modules may be used. Additionally, as will be described in greater detail below, a variety of different configurations are possible for interconnection of two or more of the sluice box modules.

Figure 2:
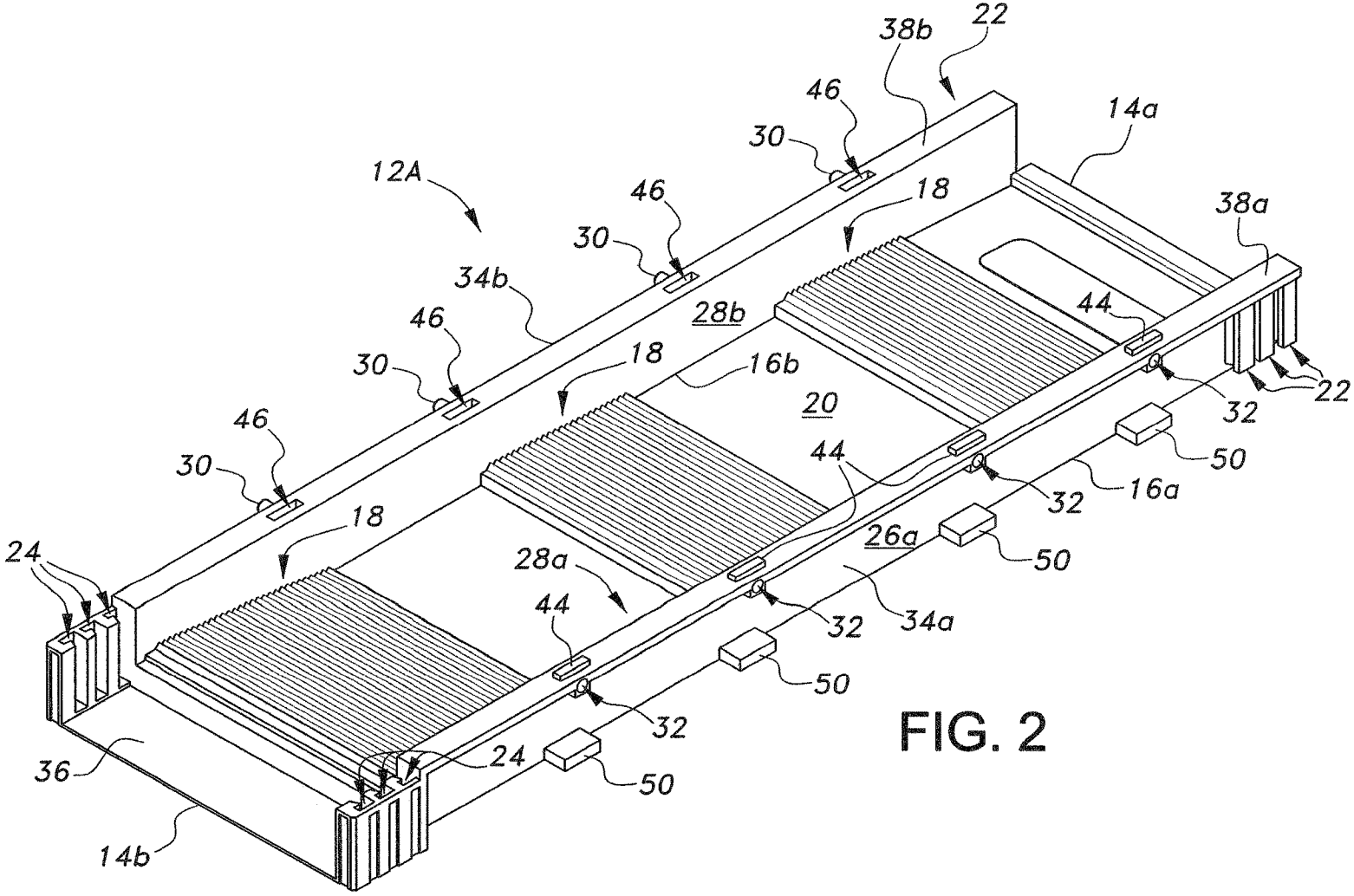
FIG. 2 is a perspective view of a single sluice box module of the modular portable sluice box of FIG. 1 as seen from the top.

Each of the sluice box modules is preferably identical. Exemplary sluice box module 12A is shown in FIG. 2, although it should be understood that sluice box modules 12B, 12C, 12D are manufactured in an identical manner. Exemplary sluice box module 12A includes a lower wall 36 having a pair of longitudinally opposed ends 14*a*, 14*b* and a pair of laterally opposed ends 16*a*, 16*b*. A plurality of riffles 18 are formed on an upper surface 20 of the lower wall 36. A pair of sidewalls 34*a*, 34*b* are respectively secured to the pair of laterally opposed ends 16*a*, 16*b* of the lower wall 36 and project upward therefrom. As will be described in greater detail below, the first end 14*a* of the pair of longitudinally opposed ends of the lower wall 36 of one of the plurality of sluice box modules may be releasably connected to the second end 14*b* of the pair of longitudinally opposed ends of the lower wall 36 of a longitudinally adjacent one of the plurality of sluice box modules. For example, in FIG. 1, sluice box modules 12A and 12C are longitudinally connected, as are sluice box modules 12B and 12D. Similarly, the first sidewall 34*a* of the pair of sidewalls of one of the plurality of sluice box modules may be releasably connected to the second sidewall 34*b* of the pair of sidewalls of a laterally adjacent one of the plurality of sluice box modules. For example, in FIG. 1, sluice box modules 12A and 12B are laterally connected, as are sluice box modules 12C and 12D.

Figure 3:
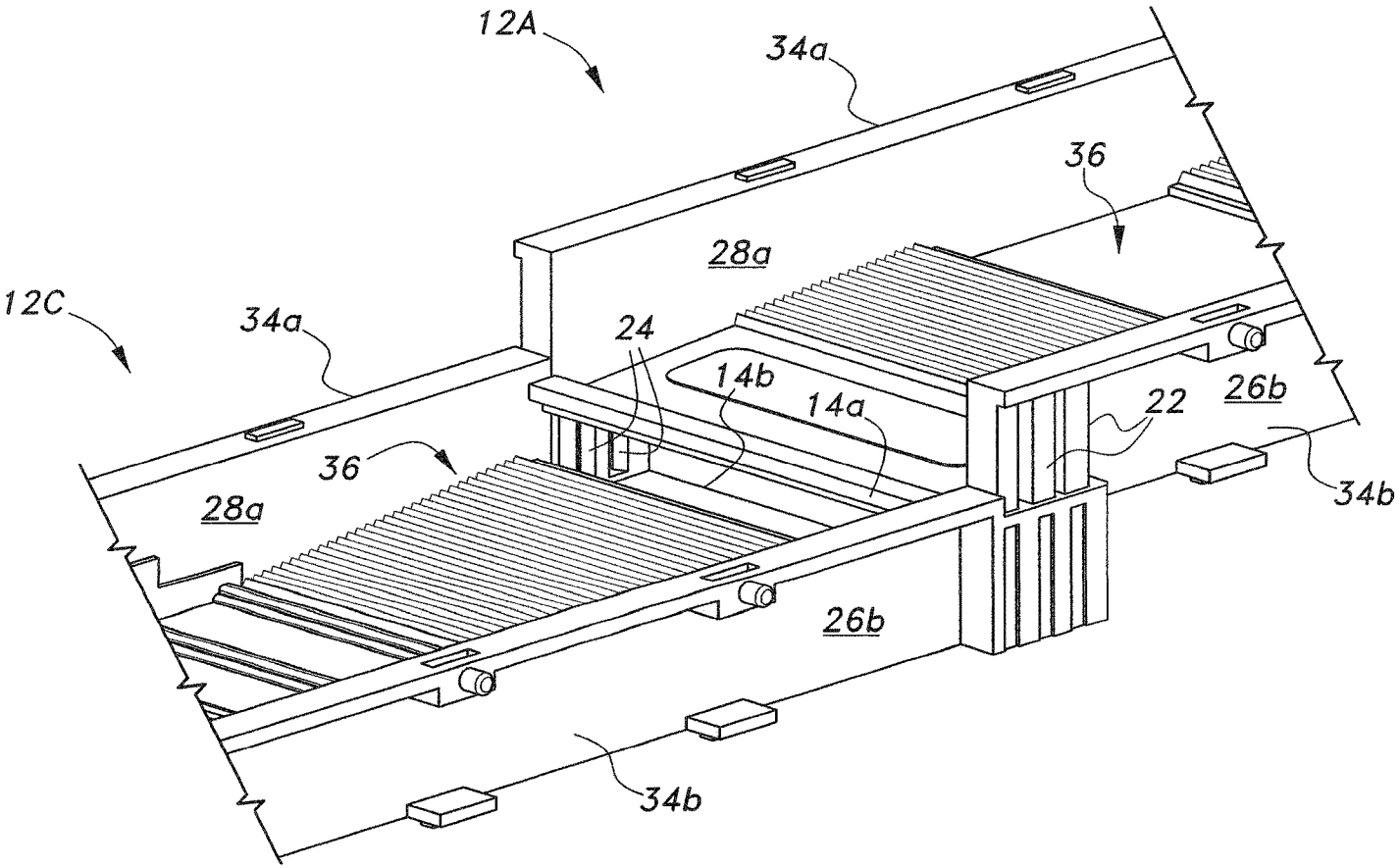
FIG. 3 is a partial perspective view of a modular portable sluice box according to the present invention, showing releasable connection of a pair of sluice box modules end-to-end to lengthen the sluice.

It should be understood that the individual sluice box modules may be longitudinally interconnected in any suitable manner. Similarly, the individual sluice box modules may be laterally interconnected in any suitable manner. As an example, as shown in FIGS. 2 and 3, exemplary sluice box module 12A includes a plurality of vertically extending ribs or rails 22 mounted on an exterior face 26*a*, 26*b* of each sidewall 34*a*, 34*b*, respectively, adjacent the first end 14*a* of the lower wall 36. A plurality of vertically extending grooves or recesses 24 are correspondingly formed on an interior face 28*a*, 28*b* of each sidewall 34*a*, 34*b*, respectively, adjacent the second end 14*b* of the lower wall 36. As shown in FIG. 3, the plurality of vertically extending rails 22 of sluice box module 12A are slidably and releasably received in the plurality of vertically extending recess 24 of longitudinally adjacent sluice box module 12C. In this way, any desired number of sluice box modules may be releasably connected to extend the overall modular portable sluice box 10 to a desired length.

Figure 4:
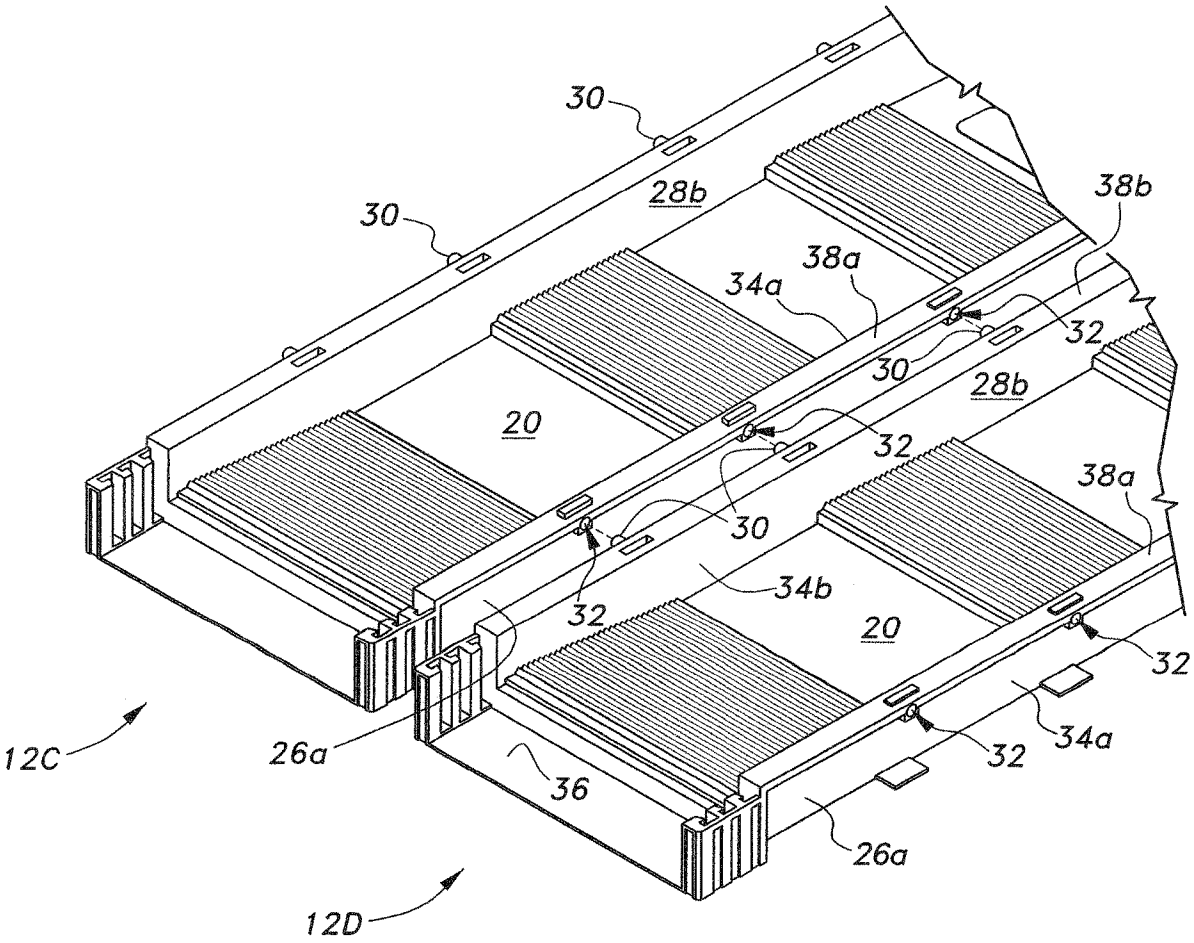
FIG. 4 is a partial perspective view of a modular portable sluice box according to the present invention, showing releasable connection of a pair of sluice box modules side-to-side to widen the sluice.

Similarly, as shown in FIGS. 2 and 4, the individual sluice box modules may be laterally interconnected. Exemplary sluice box module 12A further includes a plurality of pins or side engaging members 30 mounted on the exterior face 26*b* of the second sidewall 34*b* and projecting outward therefrom adjacent an upper edge 38*b* of the second sidewall 34*b*. A plurality of corresponding blind bores or side recesses 32 are formed on the exterior face 26*a* of the first sidewall 34*a* adjacent the upper edge 38*a* of the first sidewall 34*a*. As shown in FIG. 4, the plurality of side recesses 32 are aligned with the plurality of side engaging members 30 such that the side engaging members 30 of exemplary sluice box module 12D are releasably received by the plurality of side recesses 32 of laterally adjacent sluice box module 12C.

Figure 5:
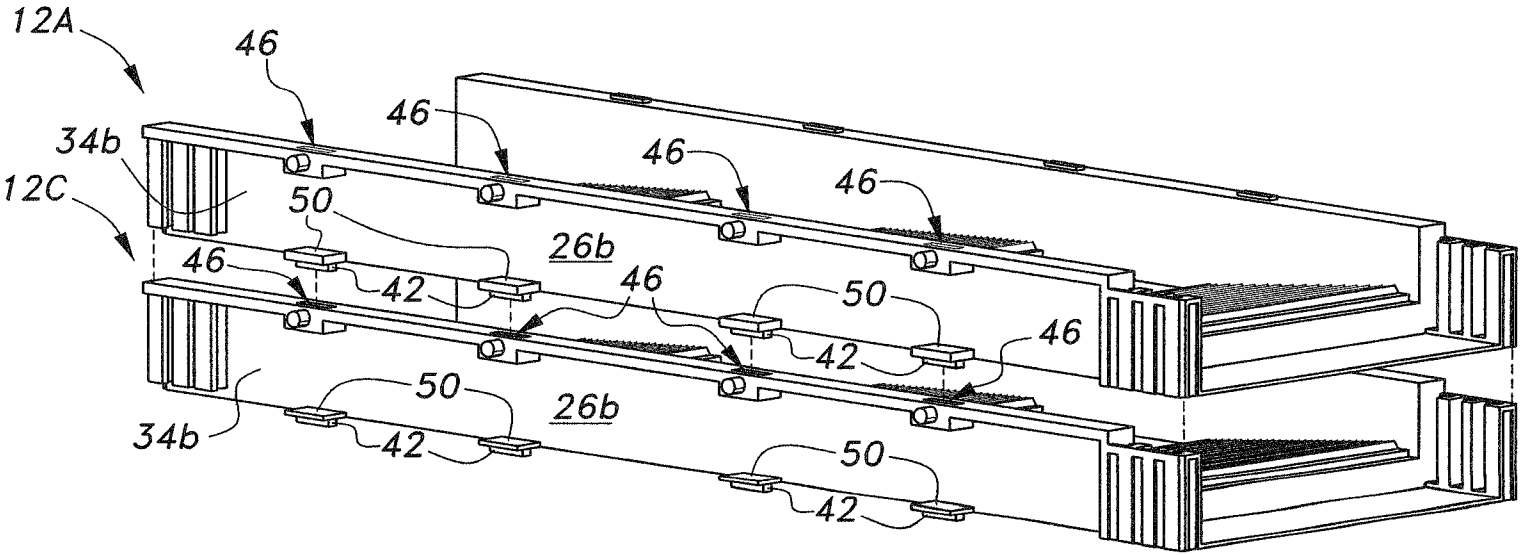
FIG. 5 is a perspective view of a modular portable sluice box according to the present invention, showing a pair of vertically stacked sluice box modules in a first stacked configuration.
Figure 6:
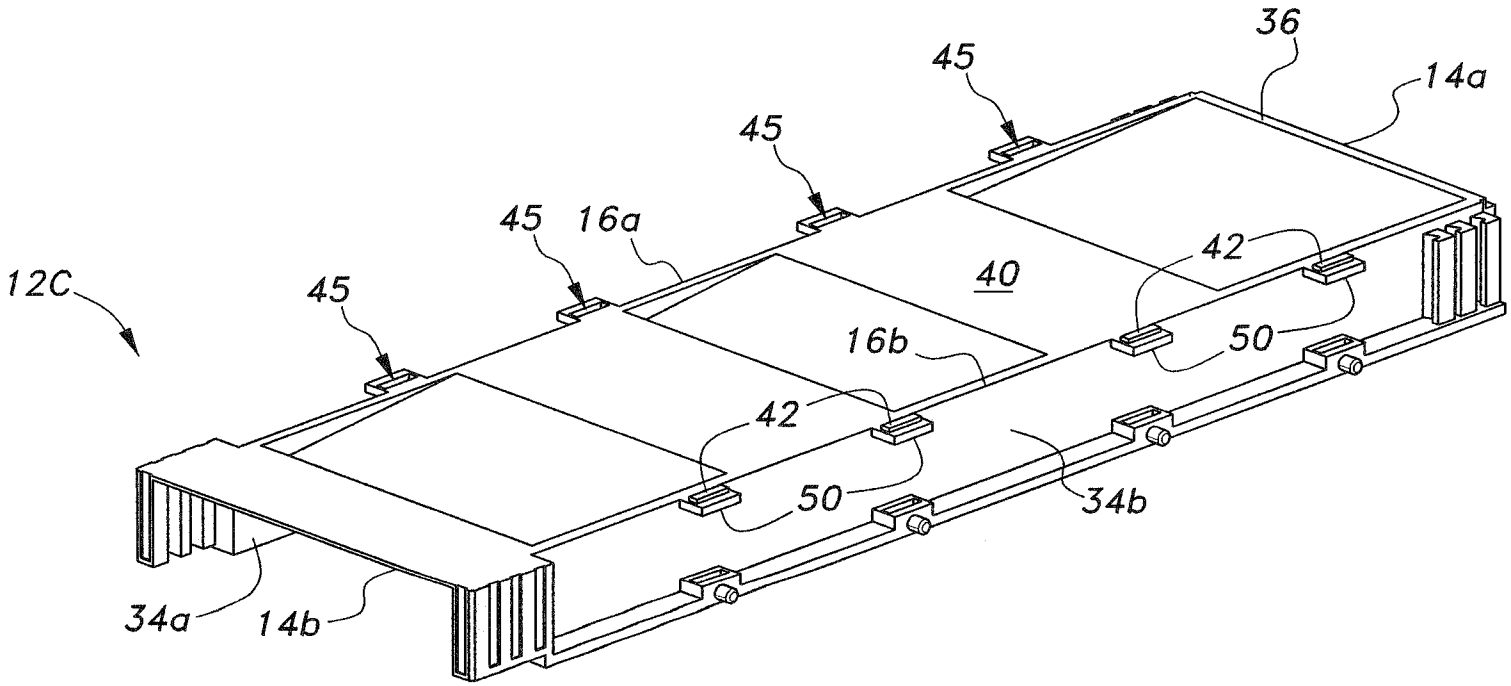
FIG. 6 is a perspective view of a single sluice box module of the modular portable sluice box of FIG. 1 as seen from the bottom.

In addition to lateral and longitudinal interconnection, the individual sluice box modules may also be vertically stacked. As shown in FIGS. 2, 5 and 6, each sluice box module further includes a plurality of lower engaging members 42 mounted on a lower surface 40 of the lower wall 36. As best seen in FIG. 6, the lower engaging members 42 are positioned adjacent the second end 16*b* of the lower wall 36. As best seen in FIGS. 5 and 6, the lower engaging members 42 may be mounted on tabs 50, which project laterally outward with respect to the lower wall 36.

A plurality of upper engaging members 44 are further mounted on the upper edge 38*a* of the first sidewall 34*a*, as best shown in FIG. 2. A corresponding plurality of lower recesses 45 are formed on the lower surface 40 of the lower wall 36 adjacent the first end 16*a* of the lower wall 36, as best shown in FIG. 6. Additionally, a plurality of upper recesses 46 are formed on the upper edge 38*b* of the second sidewall 14*b*. In a first stacked configuration, the plurality of lower engaging members 42 are releasably received in the plurality of upper recesses 46 of a vertically stacked one of the plurality of sluice box modules, and the plurality of upper engaging members 44 are also releasably received in the plurality of lower recesses 45 of the vertically stacked one of the plurality of sluice box modules. This type of interconnection is shown in FIG. 5, where the lower wall 36 of exemplary sluice box module 12A rests on the upper edges 38*a*, 38*b* of sidewalls 34*a*, 34*b* of exemplary sluice box module 12C. The use of tabs 50 allows the stacking to be slightly staggered.

Figure 7:
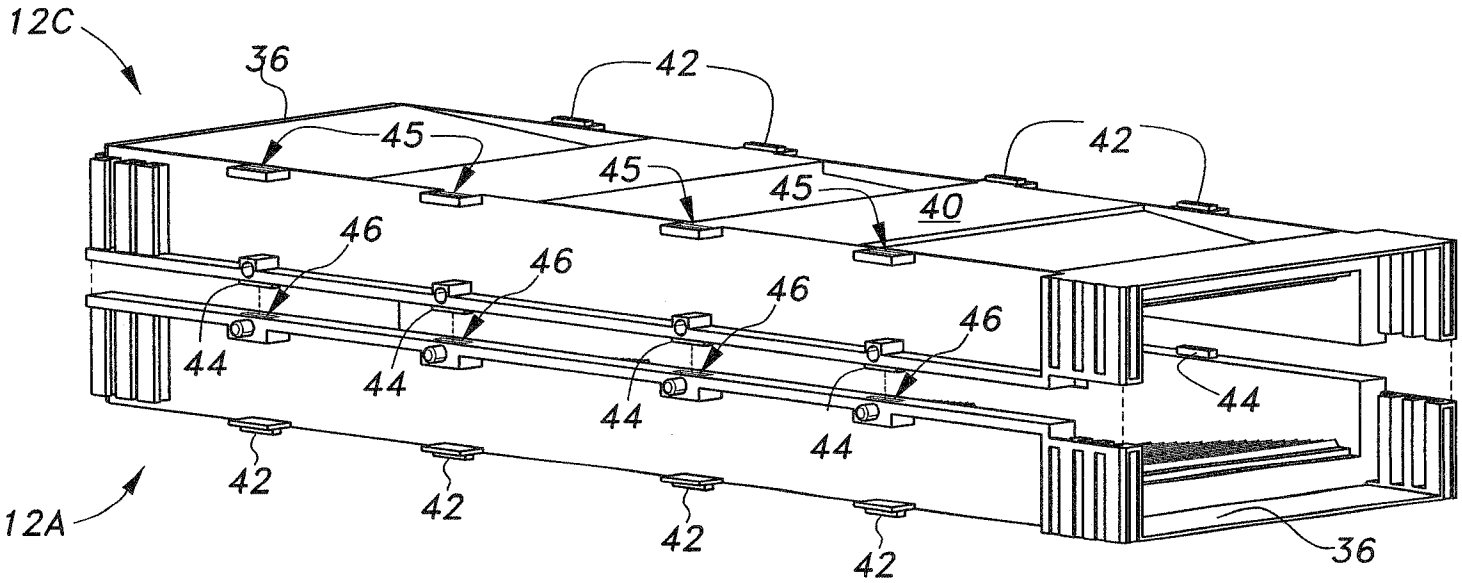
FIG. 7 is a perspective view of a modular portable sluice box according to the present invention, showing a pair of vertically stacked sluice box modules in a second stacked configuration.
Figure 8:
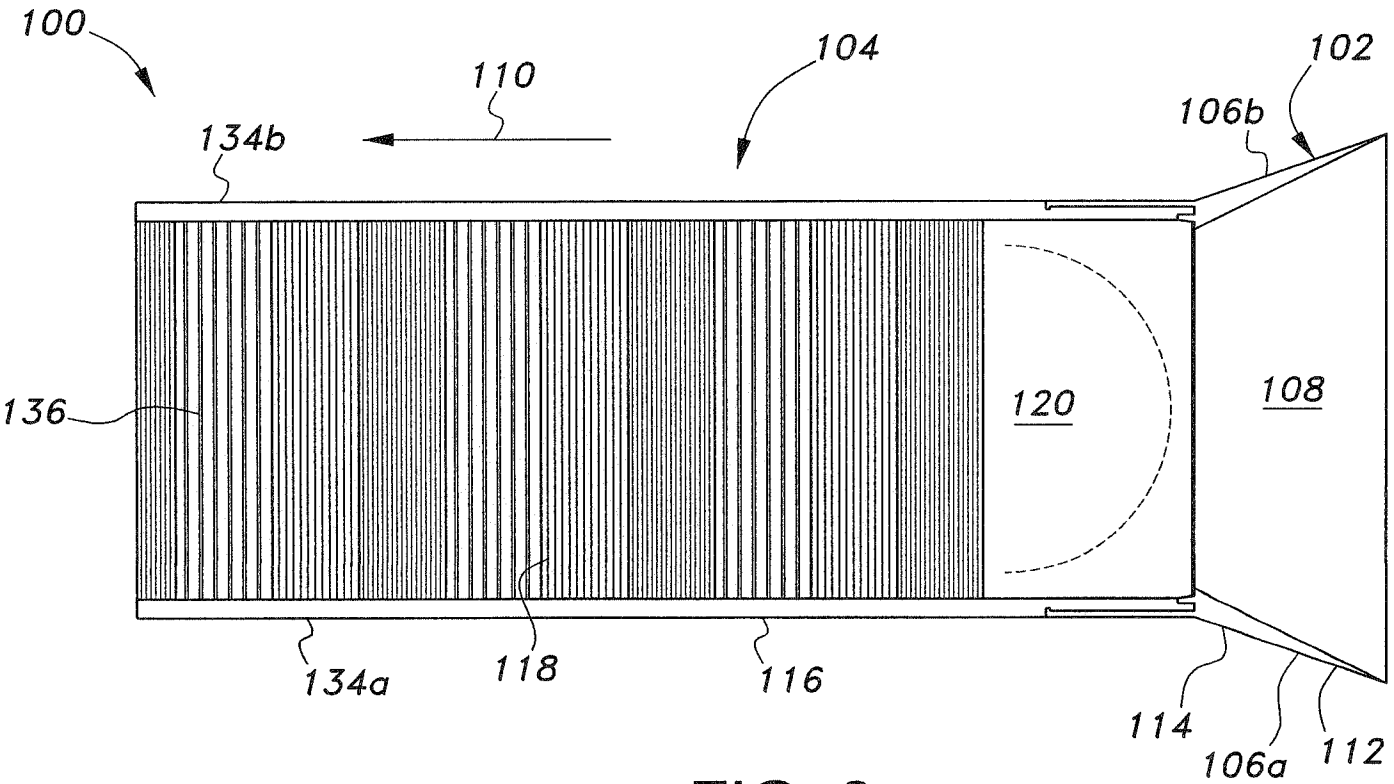
FIG. 8 PRIOR ART
FIG. 8 is a top view of a sluice box according to the prior art.

FIG. 7 illustrates an alternative vertical stacking configuration. As shown, in this configuration, the upper engaging members 44 of exemplary sluice box module 12C are received in the upper recesses 46 of exemplary sluice box module 12A, and the upper engaging members 44 of sluice box module 12A are received in the upper recesses 46 of sluice box module 12C, allowing the sluice box modules to be stacked such that their respective lower walls 36 oppose one another.

It is to be understood that the present invention is not limited to the embodiments described above, but encompasses any and all embodiments within the scope of the following claims.

I claim:

1. A modular portable sluice box, comprising:

a plurality of sluice box modules, each of the sluice box modules having:

a lower wall having an upper surface, a pair of longitudinally opposed ends, and a pair of laterally opposed ends;

a plurality of riffles formed on the upper surface of the lower wall; and a pair of sidewalls secured to the pair of laterally opposed ends of the lower wall, respectively, and projecting upward therefrom;

means for releasably connecting a first end of the pair of longitudinally opposed ends of the lower wall of one of the plurality of sluice box modules to a second end of the pair of longitudinally opposed ends of the lower wall of a longitudinally adjacent one of the plurality of sluice box modules, wherein the means for releasably connecting the first end of one of the sluice box modules to the second end of a longitudinally adjacent sluice box module comprises a plurality of vertically extending ribs mounted on an exterior face of each of the sidewalls adjacent the first end of the pair of longitudinally opposed ends of the lower wall, each of the sidewalls having a plurality of vertically extending grooves formed on an interior face thereof adjacent the second end of the pair of longitudinally opposed ends of the corresponding lower wall, the grooves slidably receiving the plurality of vertically extending ribs of the longitudinally adjacent sluice box module; and means for releasably connecting a first sidewall of the pair of sidewalls of one of the plurality of sluice box modules to a second sidewall of the pair of sidewalls of a laterally adjacent one of the plurality of sluice box modules.

2. The modular portable sluice box as recited in claim 1, wherein said means for releasably connecting the first sidewall of one of the sluice box modules to the second sidewall of the laterally adjacent sluice box module comprises a plurality of pins mounted on the exterior face of the second sidewall and projecting outward therefrom adjacent an upper edge of the second sidewall, the first sidewall having a plurality of blind bores formed on the exterior face thereof adjacent an upper edge of the first sidewall, the blind bores releasably receiving the pins of the laterally adjacent sluice box module.

3. The modular portable sluice box as recited in claim 2, wherein each said sluice box module further comprises:

a plurality of lower engaging members mounted on a lower surface of the lower wall adjacent a second end of the pair of laterally opposed ends of the lower wall; and a plurality of upper engaging members mounted on the upper edge of the first sidewall, the lower wall having a lower surface defining a plurality of lower recesses therein adjacent the first end of the pair of laterally opposed ends of the lower wall, the second sidewall having an upper edge defining a plurality of upper recesses therein, the plurality of lower engaging members being releasably received in the plurality of upper recesses of a vertically stacked one of the plurality of sluice box modules and the plurality of upper engaging members being releasably received in the plurality of lower recesses of the vertically stacked one of the plurality of sluice box modules.

4. The modular portable sluice box as recited in claim 1, wherein said means for releasably connecting the first sidewall of one of the sluice box modules to the second sidewall of the laterally adjacent sluice box module comprises a plurality of pins mounted on the exterior face of the second sidewall and projecting outward therefrom adjacent an upper edge of the second sidewall, the first sidewall having a plurality of blind bores formed on the exterior face thereof adjacent an upper edge of the first sidewall, the blind bores releasably receiving the pins of the laterally adjacent sluice box module.

5. The modular portable sluice box as recited in claim 4, wherein said means for releasably connecting the first end of one of the sluice box modules to the second end of a longitudinally adjacent sluice box module comprises a plurality of vertically extending ribs mounted on an exterior face of each said sidewall adjacent the first end of the pair of longitudinally opposed ends of the lower wall, each said sidewall having a plurality of vertically extending grooves formed on an interior face thereof adjacent the second end of the pair of longitudinally opposed ends of the corresponding lower wall, the grooves slidably receiving the plurality of vertically extending ribs of the longitudinally adjacent sluice box module.

6. The modular portable sluice box as recited in claim 1, wherein each said sluice box module further comprises:

a plurality of lower engaging members mounted on a lower surface of the lower wall adjacent a second end of the pair of laterally opposed ends of the lower wall; and a plurality of upper engaging members mounted on the upper edge of the first sidewall, the lower wall having a lower surface defining a plurality of lower recesses therein adjacent the first end of the pair of laterally opposed ends of the lower wall, the second sidewall having an upper edge defining a plurality of upper recesses therein, the plurality of lower engaging members being releasably received in the plurality of upper recesses of a vertically stacked one of the plurality of sluice box modules and the plurality of upper engaging members being releasably received in the plurality of lower recesses of the vertically stacked one of the plurality of sluice box modules.

7. The modular portable sluice box as recited in claim 6, wherein said means for releasably connecting the first end of one of the sluice box modules to the second end of a longitudinally adjacent sluice box module comprises a plurality of vertically extending ribs mounted on an exterior face of each said sidewall adjacent the first end of the pair of longitudinally opposed ends of the lower wall, each said sidewall having a plurality of vertically extending grooves formed on an interior face thereof adjacent the second end of the pair of longitudinally opposed ends of the corresponding lower wall, the grooves slidably receiving the plurality of vertically extending ribs of the longitudinally adjacent sluice box module.

8. The modular portable sluice box as recited in claim 7, wherein said means for releasably connecting the first sidewall of one of the sluice box modules to the second sidewall of the laterally adjacent sluice box module comprises a plurality of pins mounted on the exterior face of the second sidewall and projecting outward therefrom adjacent an upper edge of the second sidewall, the first sidewall having a plurality of blind bores formed on the exterior face thereof adjacent an upper edge of the first sidewall, the blind bores releasably receiving the pins of the laterally adjacent sluice box module.

9. A modular portable sluice box, comprising:

a plurality of sluice box modules, each of the sluice box modules having:

a lower wall having an upper surface, a pair of longitudinally opposed ends, and a pair of laterally opposed ends;

a plurality of riffles formed on the upper surface of the lower wall; and a pair of sidewalls secured to the pair of laterally opposed ends of the lower wall, respectively, and projecting upward therefrom;

means for releasably connecting a first end of the pair of longitudinally opposed ends of the lower wall of one of the plurality of sluice box modules to a second end of the pair of longitudinally opposed ends of the lower wall of a longitudinally adjacent one of the plurality of sluice box modules; and means for releasably connecting a first sidewall of the pair of sidewalls of one of the plurality of sluice box modules to a second sidewall of the pair of sidewalls of a laterally adjacent one of the plurality of sluice box modules, wherein the means for releasably connecting the first sidewall of one of the sluice box modules to the second sidewall of the laterally adjacent sluice box module comprises a plurality of pins mounted on the exterior face of the second sidewall and projecting outward therefrom adjacent an upper edge of the second sidewall, the first sidewall having a plurality of blind bores formed on the exterior face thereof adjacent an upper edge of the first sidewall, the blind bores releasably receiving the pins of the laterally adjacent sluice box module.

10. A modular portable sluice box, comprising:

a plurality of sluice box modules, each of the sluice box modules having:

a lower wall having an upper surface, a pair of longitudinally opposed ends, and a pair of laterally opposed ends;

a plurality of riffles formed on the upper surface of the lower wall;

a pair of sidewalls secured to the pair of laterally opposed ends of the lower wall, respectively, and projecting upward therefrom;

a plurality of lower engaging members mounted on a lower surface of the lower wall adjacent a second end of the pair of laterally opposed ends of the lower wall; and a plurality of upper engaging members mounted on the upper edge of the first sidewall, the lower wall having a lower surface defining a plurality of lower recesses therein adjacent the first end of the pair of laterally opposed ends of the lower wall, the second sidewall having an upper edge defining a plurality of upper recesses therein, the plurality of lower engaging members being releasably received in the plurality of upper recesses of a vertically stacked one of the plurality of sluice box modules and the plurality of upper engaging members being releasably received in the plurality of lower recesses of the vertically stacked one of the plurality of sluice box modules;

means for releasably connecting a first end of the pair of longitudinally opposed ends of the lower wall of one of the plurality of sluice box modules to a second end of the pair of longitudinally opposed ends of the lower wall of a longitudinally adjacent one of the plurality of sluice box modules; and means for releasably connecting a first sidewall of the pair of sidewalls of one of the plurality of sluice box modules to a second sidewall of the pair of sidewalls of a laterally adjacent one of the plurality of sluice box modules.

* * * * *